United States Patent [19]
Ota et al.
[11] 4,183,999
[45] Jan. 15, 1980

[54] GARNET SINGLE CRYSTAL FILM FOR MAGNETIC BUBBLE DOMAIN DEVICES

[75] Inventors: Norio Ota, Kokubunji; Fumihiko Ishida, Hachioji, both of Japan

[73] Assignee: Hitachi, Ltd., Japan

[21] Appl. No.: 838,873

[22] Filed: Oct. 3, 1977

[30] Foreign Application Priority Data

Oct. 8, 1976 [JP] Japan ..... 51/120329

[51] Int. Cl.[2] ..... B01N 17/00

[52] U.S. Cl. ..... 428/336; 156/605; 156/606; 252/62.57; 252/62.58; 252/62.59; 252/62.6; 252/62.62; 252/62.63; 428/539; 428/900

[58] Field of Search ..... 428/539, 900, 336; 340/174 TF; 156/605, 606; 252/62.56, 62.57, 62.58, 62.59, 62.6, 62.61, 62.62, 62.63, 62.64; 365/3, 33; 35/60, 63

[56] References Cited

U.S. PATENT DOCUMENTS

| | | | |
|---|---|---|---|
| 3,995,093 | 11/1976 | Heinz | 428/900 |
| 4,002,803 | 1/1977 | Blank | 428/900 |
| 4,093,781 | 6/1978 | Heiz et al. | 156/605 |
| 4,138,530 | 2/1979 | Breed et al. | 156/605 |

OTHER PUBLICATIONS

S. Geller et al., Bell Syst. Tech. J. vol. 43, 565 (1964).
S. Geller et al., J. Appl. Phys., vol. 36, 321 (1965).
Thiele, Bell Syst. Tech. V., vol. 50, 725 (1971).
J. T. Carlo et al., I.E.E.E. Trans. Mag. Mag-10 626 (1974).
M. A. Gilleo and S. Geller, J. Appl. Phys., vol. 29, 380 (1958).
S. Geller et al., J. Appl. Phys. vol. 36, 88 (1965).

*Primary Examiner*—Stanley S. Silverman
*Attorney, Agent, or Firm*—Craig and Antonelli

[57] ABSTRACT

A garnet single crystal film wherein part of iron ions at tetrahedral positions and octahedral positions are replaced by an appointed amount of the other ions is by far superior to prior art garnet films in that its saturation magnetization ($4\pi Ms$) and its exchange stiffness coefficient (A) can be independently controlled to a desired value and a magnetic bubble domain having a small diameter can be easily formed.

9 Claims, 2 Drawing Figures

GARNET SINGLE CRYSTAL FILM FOR MAGNETIC BUBBLE DOMAIN DEVICES

LIST OF PRIOR ART (37 CFR 1.56 (a))

Figure 1:
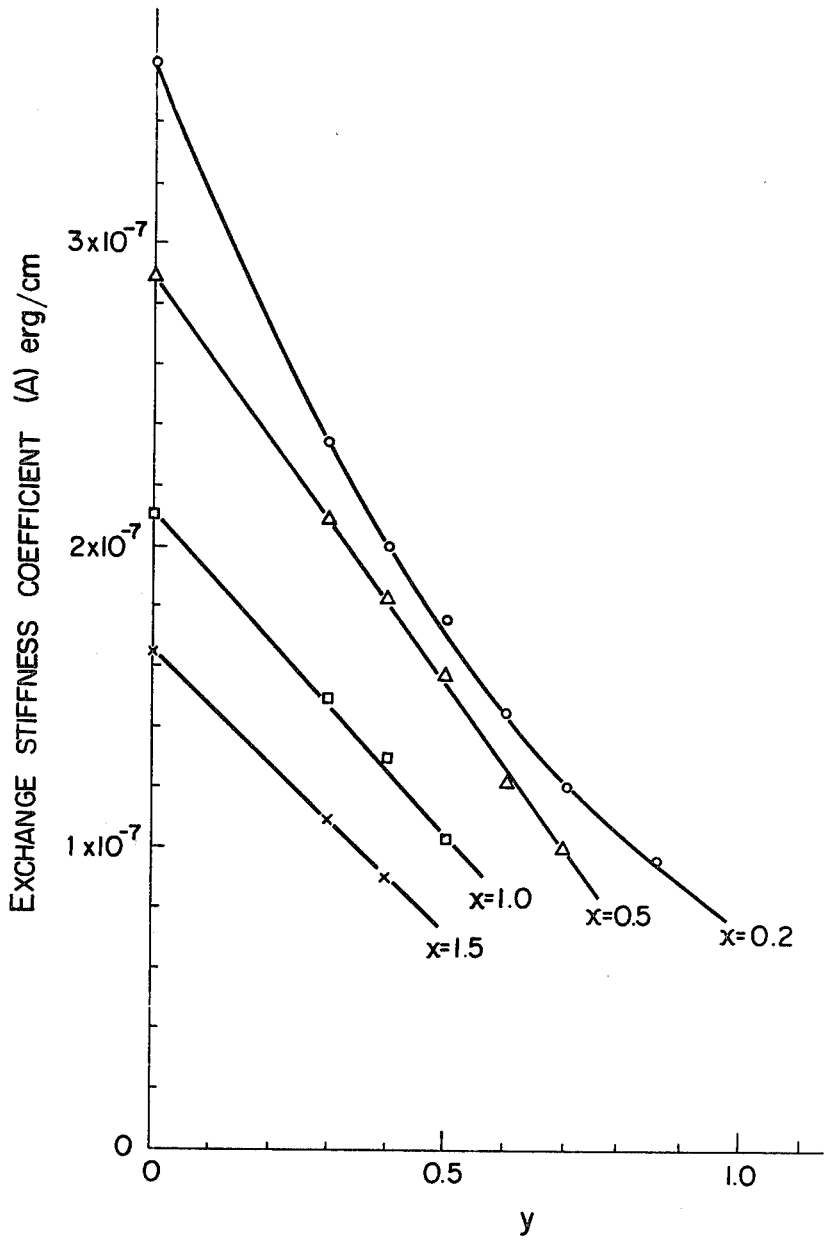

The following references are cited to show the state of the art:

(1) Thiele, Bell Syst. Tech. J., Vol. 50, 725 (1971)
(2) J. T. Carlo et al, I.E.E.E. Trans. Mag. MAG-10, 626 (1974)
(3) M. A. Gilleo and S. Geller, J. Appl. Phys., Vol. 29, 380 (1958)
(4) S. Geller et al, J. Appl. Phys., Vo. 36, 88 (1965)
(5) S. Geller et al, Bell Syst. Tech. J., Vol. 43, 565 (1964)
(6) S. Geller et al, J. Appl. Phys., Vol. 36, 321 (1965)

The present invention relates to a garnet single crystal film having uniaxial magnetic anisotropy required as a magnetic bubble domain device material.

It is well known that bubble domain devices have recently been noted as a hopeful information processing device, and particularly as a memory device, and active research and development have been carried out regarding them.

When a bubble domain device is used as a memory device, a memory density, which is one of the most important factors of memory device technology, depends upon a bubble domain diameter (d). At present, bubble domain devices having a bubble domain diameter of 4 to 5 μm are practically used. If this diameter can be decreased to 2 μm or less, a sharp increase in memory density can be expected.

In order to put magnetic bubble domain devices to a practical use a memory device in place of a disc memory or a semiconductor memory which are generally used, the diameter of their magnetic bubble domain must be decreased to 2 μm or less to improve their memory density sharply. Therefore, any material which may permit the formation of a bubble domain having such a small diameter must be found.

Here, the characteristics of the material for realizing a very small magnetic bubble domain will be considered based on Thiele's theory [Bell Syst. Tech. J., Vol. 50, page 725, (1971)].

The diameter (d) of a magnetic bubble domain varies remarkably according to the film thickness (h) even if materials for the magnetic garnet film are the same. If the film thickness (h) is selected so that the diameter (d) of the bubble domain may be smallest, d becomes almost 8 times the characteristic length (l) as represented by the equation (1).

$$d = 8l \quad (1)$$

Here, l is represented by saturation magnetization ($4\pi Ms$), anisotropy field (Hk) and exchange stiffness coefficient (A) according to the equation (2).

$$l = 2(8\pi A \cdot Hk)^{\frac{1}{2}}/(4\pi Ms)^{3/2} \quad (2)$$

Here, Hk is defined as follows using a factor (q) showing the stability of the bubble domain:

$$Hk = q \cdot (4\pi Ms)$$

Therefore, d is represented by the equation (3).

$$d = 16(8\pi A \cdot q)^{\frac{1}{2}}/4\pi Ms \quad (3)$$

Therefore, in order to make the d value small, A and q values must be as small as possible and $4\pi Ms$ value must be as large as possible. From the view point of the functions of the magnetic bubble domain memory device, however, there are the following two restrictions:

(1) In order that any extra magnetic bubble domain is not generated at places other than a bubble domain generator in the memory device, it is desirable that the value of q is 4 or more. Also, in order that a bubble domain is easily generated at the generator, it is desirable that the value of q is 8 or less.

(2) In the magnetic bubble domain devices at the present stage, a rotating magnetic field is applied into a plane parallel with the magnetic film to transfer the bubble domain. According to experimental results, the strength of the rotating magnetic field must be increased almost in proportion to $4\pi Ms$ value. In order to decrease the electric power required for generating the rotating magnetic field and suppress the generation of heat at the rotating magnetic field generating coil as far as possible, it is desirable that the value of $4\pi Ms$ is as small as possible.

Due to these two restrictions, only A is a free factor in the equation (3). In other words, any material having a small d value must be found by making the A value small. In prior art magnetic garnet materials, however, the A was not a free factor and was an amount closely associated with $4\pi Ms$ for the reasons as described below. The major part of saturation magnetization of iron garnet is formed by a difference between the magnetization of iron ions at tetrahedral positions ($Fe^{3+}$: 3 moles per formula unit) and the magnetization of iron ions at octahedral positions arranged in the direction opposite to the former iron ion ($Fe^{3+}$: 2 moles per formula unit).

A magnetic film having a desirable $4\pi Ms$ value has heretofore been obtained by replacing iron ions ($Fe^{3+}$) at tetrahedral positions by gallium ion ($Ga^{3+}$), aluminum ion ($Al^{3+}$), silicon ion ($Si^{4+}$), germanium ion ($Ge^{4+}$), etc. which are strong in selectivity of tetrahedral positions.

If the amount of iron ions at tetrahedral positions replaced by said gallium ion, etc. is x, however, $4\pi Ms$ value is almost proportional to $(1-x)$ and A value is almost proportional to $(5-x)$. If part of iron ions at tetrahedral positions are replaced by gallium ion, etc. to obtain a desirable $4\pi Ms$ value, therefore, not only the $4\pi Ms$ value but also the A value is fixed and the desired A value can not be obtained. Therefore, it was very difficult to reduce the diameter of a magnetic bubble domain in prior art magnetic films by utilizing the equation (3).

An object of the present invention is to solve the above-mentioned problems in prior art magnetic films.

Another object of the invention is to provide a garnet single crystal film for magnetic bubble domain devices wherein a magnetic bubble domain having a very small diameter can be formed.

The other objects and advantages of the present invention will be apparent from the following description.

In order to attain the above-mentioned objects, an appointed amount of iron ions at not only tetrahedral positions but also octahedral positions are replaced by specific ions according to the present invention. Thereby, it is possible to reduce the A value enough and reduce the d value even if $4\pi Ms$ value is small.

In the accompanying drawings, FIG. 1 shows a relationship between x, y and exchange stiffness coefficient (A) in a single crystal film of the formula $$\{Eu, Tm, Ca\}_3[Fe_{2-y}In_y].[Fe_{3-x}Ge_x]O_{12}$$

Figure 2:
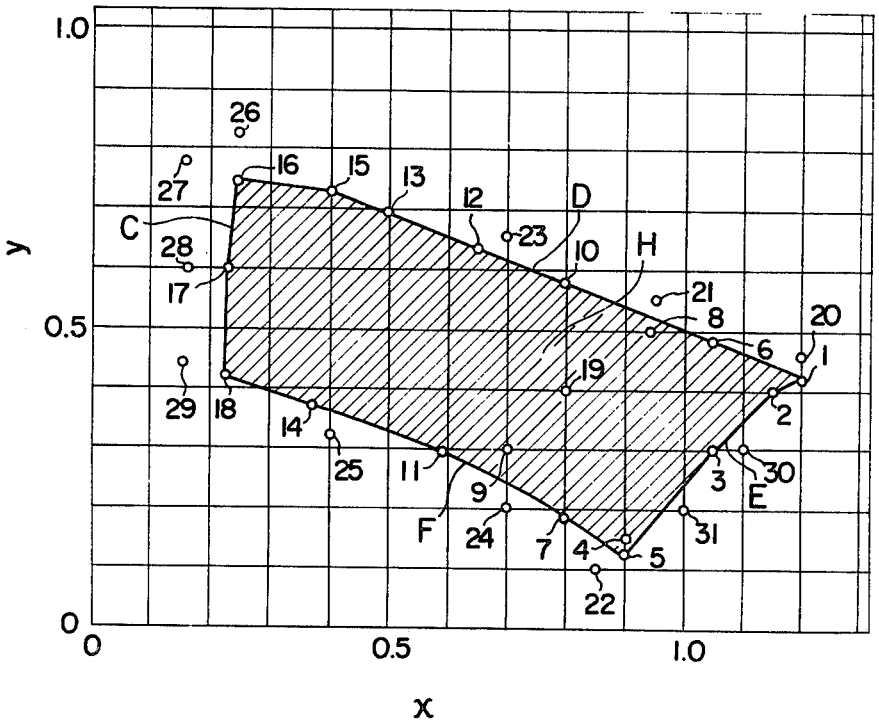

FIG. 2 shows the range of x and y values in the garnet single crystal film according to the present invention.

According to the present invention, there is provided a garnet single crystal film for magnetic bubble domain devices having a composition represented by the formula $$R_3(Fe_{3-x}M_x)(Fe_{2-y}M'_y)O_{12}$$

wherein R is at least one member selected from the group consisting of Y, Ca, La, Ce, Pr, Nd, Pm, Sm, Eu, Gd, Tb, Dy, Ho, Er, Tm, Yb and Lu; M is at least one member selected from the group consisting of Ge, Al, Si and Ga; M' is at least one member selected from the group consisting of Sc, In, Cr, Zr and Sn; and x and y each have a value within the range H in FIG. 2.

As explained above, $4\pi$Ms of a magnetic garnet film has been controlled by replacing part of iron ions at tetrahedral positions by gallium ion, silicon ion, aluminum ion, germanium ion, etc.

On the one hand, the curie temperature (Tc) of the magnetic film depends upon the total amount of iron ions contained in the garnet film and has no relation with the position of the iron ions. Further, Tc is associated closely with A, and Tc and A values decrease with a decrease in the total amount of iron ions. Therefore, a magnetic garnet film having a desired A value can be formed by varying the total amount of iron ions.

Since $4\pi$Ms of a magnetic garnet film depends upon the amount of iron ions at tetrahedral positions, only iron ions at tetrahedral positions have heretofore been replaced by the other ions and iron ions at octahedral positions have not been replaced. In prior art magnetic garnet films, therefore, A value is fixed if a certain value is given to $4\pi$Ms. Thus, it has been impossible to control A and $4\pi$Ms values independently.

On the other hand, according to the present invention, not only iron ions at tetrahedral positions but also part of iron ions at octahedral positions are replaced by the other ions. As a result, it is possible to control $4\pi$Ms and A values independently to respective desired values.

The composition of the magnetic garnet film according to the present invention is represented by the formula $$R_3(Fe_{3-x}M_x)(Fe_{2-y}M'_y)O_{12}$$

wherein R is a substance at dodecahedral sites and is at least one element selected from the group consisting of Y, Ca, La, Ce, Pr, Nd, Pm, Eu, Gd, Tb, Dy, Ho, Er, Tm, Yb and Lu; M is a substance for replacing iron at tetrahedral positions and is at least one element selected from the group consisting of Ge, Al, Si and Ga; and M' is a substance for replacing iron at octahedral positions and is at least one element selected from the group consisting of Sc, In, Cr, Zr and Sn.

Saturation magnetization ($4\pi$MS) in the magnetic garnet film depends mainly upon the effective magneton number of $\{(3-x)-(2-y)\}$ iron ions per composition formula while Tc and A depend upon the total amount of $(5-x-y)$ iron ions per formula unit. Therefore, the A value can be reduced while the $4\pi$Ms is maintained at a desirable value and the diameter (d) of the magnetic bubble domain can be reduced by varying x and y values independently.

The magnetic garnet films according to the present invention having different thicknessses can be used as a magnetic bubble domain device. The thickness of the film is fixed to be almost ½ of the diameter (d) of the magnetic bubble domain. If the magnetic garnet film of the present invention is used, a magnetic bubble domain having a far smaller diameter can be formed as compared with prior arts. Also, the diameter of the magnetic bubble domain can be varied over a wide range by varying the thickness of the film.

The thickness of the film usable as a magnetic film for magnetic bubble domain devices is about 0.2 μm to about 40 μm, but very preferable results can be obtained when the thickness is about 0.3 μm to about 1.2 μm.

The following examples illustrate the present invention. Example 1

The magnetic characteristics of several magnetic garnet films are shown in Table 1. Among these films, No. 1 is one example of prior art films and Nos. 2 to 5 are the films of the present invention.

All the films were prepared according to liquid phase epitaxial growth method by rotating a $Gd_3Ga_5O_{12}$ single crystal substrate at 100 r.p.m. at a temperature of 900° to 1000° C.

In No. 1 $(Eu_{1.0}Tm_{2.0})(Fe_{4.55}Ga_{0.45})O_{12}$ as a prior art magnetic garnet film, only part of iron ions at tetrahedral positions were replaced by gallium ion.

As is seen from Table 1, the diameter (d) of a magnetic bubble domain was almost the same as that of the other films, but exchange stiffness coefficient (A) and saturation magnetization ($4\pi$Ms) were considerably larger than those of the other films.

When a magnetic bubble domain transfer experiment was carried out with this film, it was found that the film was substantially unpractical since the lower limit value of rotating magnetic field was as large as 70 Oe and the generation of heat in coil was remarkably large.

In No. 2 $(Eu_{0.8}Tm_{2.2})(Fe_{4.1}Ga_{0.6}Sc_{0.3})O_{12}$ as one example of the films of the present invention, part of iron ions at tetrahedral positions and octahedral positions were replaced by gallium and scandium ions. Since the sum of the remaining iron ions was smaller than in No. 1, Tc, A and $4\pi$Ms values were all smaller than in No. 1 in spite of the fact that d and q values were almost the same as those of No. 1. When a transfer experiment was carried out with this film in the same manner as in No. 1, it was found that the film was practical in that the lower limit value of rotary magnetic field was 55 Oe and considerably smaller than in No. 1 and the generation of heat in coil was slight.

In No. 3 $(Eu_{0.7}Tm_{2.2})(Fe_{3.8}Ga_{0.8}Sc_{0.3})O_{12}$, a larger amount of iron ions was replaced than in No. 2 and A value was smaller. Also, Tc and $4\pi$Ms values were smaller than those of No. 2, the lower limit value of rotary magnetic field decreased to 45 Oe, and it was unnecessary to take into account the generation of heat in coil.

In No. 4 $(Eu_{0.5}Gd_{1.0}Lu_{1.5})(Fe_{4.0}Al_{0.5}In_{0.5})O_{12}$, part of iron ions at tetrahedral positions and octahedral positions were replaced by aluminum and indium ions. The characteristics of this film were almost similar to those of No. 2 film. Tc, A and $4\pi$Ms values thereof were all smaller than those of No. 1.

In No. 5 $(Eu_{0.5}Lu_{1.3}Ca_{0.9})(Fe_{3.7}Ge_{0.9}In_{0.4})O_{12}$, part of iron ions at tetrahedral positions and octahedral positions were replaced by germanium ion and indium ion and the same amount of calcium ion as that of germanium ion was introduced to dodecahedral sites to compensate the electric charge. The A value was small and the film showed preferable characteristics as a magnetic film for magnetic bubble domain devices since part of iron ions at octahedral positions were replaced by indium ion as in the films Nos. 2–4.

Example 2

Many magnetic garnet films having the other compositions according to the present invention were prepared and their magnetic characteristics were measured in the same manner as in Example 1. The results obtained are shown in Table 2. In all the many films, A, Tc and $4\pi Ms$ values were small and it was thereby confirmed that the magnetic garnet films according to the present invention had very preferable characteristics as a magnetic film for magnetic bubble domain devices.

Thus, the magnetic garnet films of the present invention are very excellent as a film for magnetic bubble domain devices, but the amounts (x and y) of M and M' in the above-mentioned formula for replacing iron ions at tetrahedral positions and octahedral positions, respectively, must be within a definite range in order that the A value is small and the films have excellent effects.

FIG. 1 shows a relationship between A and y using x as a parameter. A is related to both x and y. If the value of x is constant, the y value must be increased in order to decrease the A value. It is preferable that the A value is as small as possible, but the Tc value also reduces with a decrease in the A value. If the Tc value is too small, the operable temperature range for the magnetic bubble domain devices becomes very narrow. Therefore, it is required that the Tc value is 100° C. or more. For this reason there is a lower limit of the A value.

When the Tc value is 100° C., the A value is about $1\times10^{-7}$ erg/cm. If the A value is $2\times10^{-7}$ erg/cm or more, the indispensable requisite for the present invention can not be satisfied. Therefore, a preferable range of the A value is $1\times10^{-7}$ to $2\times10^{-7}$ erg/cm.

Table 3 shows the magnetic characteristics of the magnetic films according to the present invention having the compositions represented by the formula $$[R]_3(Fe_{3-x}Ge_x)(Fe_{2-y}In_y)O_{12}$$

wherein R, x and y are widely varied.

Also, FIG. 2 is a graph obtained by plotting the x and y values of these magnetic films in Table 3. In FIG. 2, the numerals attached to plot-points (o) correspond to "No." in Table 3.

As is clear from Table 3, the magnetic films wherein the A value is more than $2\times10^{-7}$ erg/cm are Nos. 22, 24 and 25. Therefore, y must have a value above the curve F in FIG. 2 in order that the A value is $2\times10^{-7}$ erg/cm or less.

On the other hand, it is necessary from a practical point of view that the Tc value is 100° C. or more. As is seen from Table 3, the Tc value is less than 100° C. in the films Nos. 20, 21, 23 and 26. Therefore, y must have a value below the curve D in FIG. 2.

The magnetic films Nos. 27, 28 and 29 are unpractical in that their $4\pi Ms$ values exceed 1,000 gauss. Therefore, x must have a value at the right of the curve C connecting the points 16, 17 and 18 in FIG. 2.

If the x value is too large, the $4\pi Ms$ value becomes excessively small and the d value can not be decreased enough. It is not preferable. Therefore, a preferable range lies at the left of the curve E connecting the points 1, 2, 3 and 5 in FIG. 2. The range of the x values wherein the $4\pi Ms$ value becomes practically most convenient and which is most preferable in the formation of a magnetic bubble domain device is 0.2 to 0.8.

As is clear from the above explanation, the amounts (x and y) of iron ions at tetrahedral positions and octahedral positions replaced are preferably within the range (H) surrounded by the curves C, D, E and F in FIG. 2.

FIGS. 1 and 2 and Table 3 are the results obtained with the magnetic films of the present invention having the compositions $(Eu, Tm, Ca)(Fe_{3-x}Ge_x)(Fe_{2-y}In_y)O_{12}$, but similar results were also obtained with regard to the magnetic films of the present invention having the other compositions and the preferable range of x and y values was confirmed.

The magnetic films according to the present invention can be formed by usual liquid phase epitaxial growth method using a $Gd_3Ga_5O_{12}$ (GGG) single crystal substrate. One example thereof will be shown below.

An appointed amount each of the starting oxides was charged into a platinum crucible and heated at 1200° C. for 10 hours to form a uniform melt. The melt was cooled at a rate of 1°–5° C./hour to a temperature of 10°–20° C. higher than the saturation temperature Ts (about 920°–940° C.). After stirring with a platinum jig at 200 r.p.m. for 30 minutes, the melt was further cooled to a temperature of 5°–30° C. lower than Ts and then maintained at the temperature for 30 minutes to stabilize the melt. A G.G.G. substrate was placed at a position of about 1 cm above the surface of the melt and preheated for about 15 minutes. Thereafter, the G.G.G. substrate was dipped in the melt at a position of about 1 cm below the surface of the melt and epitaxial growth was carried out by rotating the substrate at 100 r.p.m. After growth to a desired thickness, the substrate was removed from the melt and then rotated at 4,000 r.p.m. to remove unnecessary melt stuck to the substrate.

Table 1

| Sample No. | Composition of film | Diameter of magnetic bubble domain d (μm) | q $(\frac{Hk}{4\pi Ms})$ | Exchange stiffness coefficient A (erg/cm) | Curie temperature Tc (°C.) | Saturation magnetization $4\pi Ms$ (gauss) | Anisotropy field Hk (Oe) |
|---|---|---|---|---|---|---|---|
| 1 | $(Eu_{1.0}Tm_{2.0})(Fe_{4.55}Ga_{0.45})O_{12}$ | 1.07 | 3.9 | $3.20\times10^{-7}$ | 227 | 814 | 3175 |
| 2 | $(Eu_{0.8}Tm_{2.2})(Fe_{4.1}Ga_{0.6}Sc_{0.3})O_{12}$ | 1.05 | 4.0 | $1.55\times10^{-7}$ | 152 | 601 | 2404 |
| 3 | $(Eu_{0.7}Tm_{2.3})(Fe_{3.8}Ga_{0.8}Sc_{0.4})O_{12}$ | 1.08 | 4.1 | $1.10\times10^{-7}$ | 113 | 498 | 2045 |
| 4 | $(Eu_{0.5}Gd_{1.0}Lu_{1.5})(Fe_{4.0}Al_{0.5}In_{0.5})O_{12}$ | 0.98 | 3.8 | $1.56\times10^{-7}$ | 155 | 630 | 2395 |
| 5 | $(Eu_{0.8}Lu_{1.3}Ca_{0.9})(Fe_{3.7}Ge_{0.9}In_{0.4})O_{12}$ | 1.02 | 4.0 | $1.40\times10^{-7}$ | 142 | 588 | 2354 |

Table 2

| Composition of film | Diameter of magnetic bubble domain d (μm) | q | A (erg/cm) | Tc (°C.) | 4πMs (gauss) | Hk (Oe) |
|---|---|---|---|---|---|---|
| $\{Eu_{1.0}Tm_{1.2}Ca_{0.8}\}[Fe_{1.6}In_{0.4}](Fe_{2.2}Ge_{0.8})O_{12}$ | 1.05 | 4 | $1.52 \times 10^{-7}$ | 152 | 595 | 2380 |
| $\{Eu_{1.0}Tm_{1.3}Ca_{0.7}\}[Fe_{1.7}Sc_{0.3}](Fe_{2.3}Ge_{0.7})O_{12}$ | 1.10 | 4.3 | $1.80 \times 10^{-7}$ | 175 | 641 | 2760 |
| $\{Eu_{1.0}Tm_{1.2}Ca_{0.8}\}[Fe_{1.7}Cr_{0.3}](Fe_{2.2}Ge_{0.8})O_{12}$ | 0.98 | 3.9 | $1.72 \times 10^{-7}$ | 170 | 670 | 2610 |
| $\{Eu_{1.3}Tm_{0.6}Ca_{1.1}\}[Fe_{1.6}Zr_{0.4}](Fe_{2.3}Ge_{0.7})O_{12}$ | 1.00 | 4.0 | $1.62 \times 10^{-7}$ | 165 | 646 | 2582 |
| $\{Eu_{1.4}Tm_{0.3}Ca_{1.3}\}[Fe_{1.5}Sn_{0.5}](Fe_{2.2}Ge_{0.8})O_{12}$ | 1.03 | 4.2 | $1.38 \times 10^{-7}$ | 182 | 611 | 2564 |
| $\{Eu_{1.0}Tm_{1.4}Ca_{0.6}\}[Fe_{1.5}In_{0.5}](Fe_{2.4}Si_{0.6})O_{12}$ | 1.00 | 4.2 | $1.55 \times 10^{-7}$ | 154 | 647 | 2718 |
| $\{Eu_{1.0}Tm_{1.3}Ca_{0.7}\}[Fe_{1.4}Sc_{0.6}](Fe_{2.3}Si_{0.7})O_{12}$ | 1.04 | 4.0 | $1.37 \times 10^{-7}$ | 130 | 593 | 2375 |
| $\{Eu_{1.2}Tm_{1.2}Ca_{0.6}\}[Fe_{1.6}Cr_{0.4}](Fe_{2.4}Si_{0.6})O_{12}$ | 0.95 | 3.9 | $1.62 \times 10^{-7}$ | 165 | 637 | 2490 |
| $\{Eu_{1.3}Tm_{0.6}Ca_{1.1}\}[Fe_{1.5}Zr_{0.5}](Fe_{2.4}Si_{0.6})O_{12}$ | 0.98 | 4.1 | $1.58 \times 10^{-7}$ | 160 | 645 | 2647 |
| $\{Eu_{1.4}Tm_{0.3}Ca_{1.3}\}[Fe_{1.4}Sn_{0.6}](Fe_{2.3}Si_{0.7})O_{12}$ | 1.02 | 4.1 | $1.20 \times 10^{-7}$ | 122 | 562 | 2306 |
| $\{Eu_{0.8}TM_{2.2}\}[Fe_{1.7}Sc_{0.3}](Fe_{2.4}Ga_{0.6})O_{12}$ | 1.05 | 4.0 | $1.55 \times 10^{-7}$ | 152 | 601 | 2404 |
| $\{Eu_{0.8}Tm_{2.2}\}[Fe_{1.6}In_{0.4}](Fe_{2.4}Ga_{0.6})O_{12}$ | 1.02 | 4.1 | $1.43 \times 10^{-7}$ | 141 | 614 | 2518 |
| $\{Eu_{1.0}Tm_{2.0}\}[Fe_{1.7}Cr_{0.3}](Fe_{2.4}Ga_{0.6})O_{12}$ | 1.03 | 4.5 | $1.55 \times 10^{-7}$ | 155 | 670 | 3014 |
| $\{Eu_{1.0}Tm_{1.7}Ca_{0.3}\}[Fe_{1.7}Zr_{0.3}](Fe_{2.4}Ga_{0.6})O_{12}$ | 0.99 | 4.0 | $1.51 \times 10^{-7}$ | 150 | 623 | 2493 |
| $\{Eu_{1.1}Tm_{1.5}Ca_{0.4}\}[Fe_{1.6}Sn_{0.4}](Fe_{2.3}Ga_{0.7})O_{12}$ | 0.97 | 4.0 | $1.30 \times 10^{-7}$ | 133 | 578 | 2313 |
| $\{Eu_{0.5}Gd_{1.0}Lu_{1.5}\}[Fe_{1.5}In_{0.5}](Fe_{2.5}Al_{0.5})O_{12}$ | 0.98 | 3.8 | $1.56 \times 10^{-7}$ | 155 | 630 | 2395 |
| $\{Eu_{1.0}TM_{2.0}\}[Fe_{1.5}Sc_{0.5}](Fe_{2.4}Al_{0.6})O_{12}$ | 1.01 | 4.0 | $1.49 \times 10^{-7}$ | 147 | 613 | 2452 |
| $\{Eu_{1.1}Tm_{1.9}\}[Fe_{1.4}Cr_{0.6}](Fe_{2.4}Al_{0.7})O_{12}$ | 1.00 | 4.1 | $1.30 \times 10^{-7}$ | 132 | 585 | 2400 |
| $\{Eu_{0.9}Tm_{1.6}Ca_{0.5}\}[Fe_{1.5}Zr_{0.5}](Fe_{2.5}Al_{0.5})O_{12}$ | 1.01 | 3.9 | $1.55 \times 10^{-7}$ | 153 | 638 | 2488 |
| $\{Eu_{1.0}Tm_{1.4}Ca_{0.6}\}[Fe_{1.4}Sn_{0.6}](Fe_{2.3}Al_{0.7})O_{12}$ | 1.02 | 4.3 | $1.43 \times 10^{-7}$ | 140 | 617 | 2652 |
| $\{Eu_{1.0}Tm_{2.0}\}[Fe_{1.5}Sc_{0.3}In_{0.2}])Fe_{2.4}Al_{0.6})O_{12}$ | 1.01 | 4.0 | $1.49 \times 10^{-7}$ | 147 | 613 | 2452 |
| $\{Eu_{1.0}Tm_{1.3}Ga_{0.7}\}[Fe_{1.4}In_{0.3}Sc_{0.3}]$-$(Fe_{2.4}Si_{0.6})O_{12}$ | 0.95 | 3.9 | $1.62 \times 10^{-7}$ | 165 | 637 | 2490 |
| $\{Eu_{1.0}Tm_{2.0}\}[Fe_{1.4}Cr_{0.3}Sc_{0.3}](Fe_{2.5}Al_{0.5})O_{12}$ | 1.00 | 4.1 | $1.30 \times 10^{-7}$ | 132 | 585 | 2400 |
| $\{Eu_{1.2}Tm_{1.2}Ca_{0.4}\}[Fe_{1.4}Zr_{0.4}Sc_{0.2}]$-$(Fe_{2.4}Si_{0.6})O_{12}$ | 0.95 | 3.9 | $1.62 \times 10^{-7}$ | 165 | 637 | 2490 |
| $\{Eu_{1.2}Tm_{1.8}\}[Fe_{1.4}Sc_{0.2}In_{0.2}Cr_{0.2}]$-$(Fe_{2.3}Si_{0.7})O_{12}$ | 1.04 | 4.0 | $1.37 \times 10^{-7}$ | 130 | 593 | 2400 |

Table 3

| No. | R | x | y | d (μm) | 4πMs (gauss) | A ($\times 10^{-7}$ erg/cm) | q | Tc (°C.) |
|---|---|---|---|---|---|---|---|---|
| 1 | $Eu_{0.5}Tm_{1.3}Ca_{1.2}$ | 1.21 | 0.42 | 2.0 | 259 | 1.02 | 4.1 | 100 |
| 2 | $Eu_{0.6}Tm_{1.2}Ca_{1.2}$ | 1.15 | 0.40 | 1.9 | 303 | 1.15 | 4.5 | 114 |
| 3 | $Eu_{0.6}Tm_{1.3}Ca_{1.1}$ | 1.05 | 0.30 | 1.7 | 356 | 1.43 | 4.0 | 141 |
| 4 | $Eu_{0.7}Tm_{1.4}Ca_{0.9}$ | 0.90 | 0.15 | 1.9 | 361 | 1.95 | 4.3 | 187 |
| 5 | $Eu_{0.6}Tm_{1.5}Ca_{0.9}$ | 0.90 | 0.12 | 2.0 | 337 | 2.00 | 4.0 | 191 |
| 6 | $Eu_{0.9}Tm_{1.0}Ca_{1.1}$ | 1.05 | 0.48 | 1.0 | 512 | 1.03 | 4.3 | 101 |
| 7 | $Eu_{0.7}Tm_{1.5}Ca_{0.8}$ | 0.80 | 0.19 | 1.5 | 456 | 1.99 | 4.0 | 190 |
| 8 | $Eu_{1.0}Tm_{1.0}Ca_{1.0}$ | 0.95 | 0.50 | 0.93 | 592 | 1.08 | 4.4 | 106 |
| 9 | $Eu_{1.0}Tm_{1.3}Ca_{0.7}$ | 0.70 | 0.30 | 1.10 | 641 | 1.80 | 4.3 | 175 |
| 10 | $Eu_{1.2}Tm_{1.0}Ca_{0.8}$ | 0.80 | 0.58 | 0.74 | 750 | 1.00 | 4.8 | 101 |
| 11 | $Eu_{1.2}Tm_{1.2}Ca_{0.6}$ | 0.60 | 0.29 | 1.12 | 706 | 1.98 | 4.9 | 189 |
| 12 | $Eu_{1.4}Tm_{0.9}Ca_{0.7}$ | 0.65 | 0.63 | 0.69 | 850 | 1.04 | 5.2 | 100 |
| 13 | $Eu_{2.0}Tm_{0.5}Ca_{0.5}$ | 0.50 | 0.70 | 0.68 | 910 | 1.02 | 5.8 | 101 |
| 14 | $Eu_{1.9}Tm_{0.7}Ca_{0.4}$ | 0.37 | 0.37 | 0.90 | 880 | 2.00 | 4.9 | 189 |
| 15 | $Eu_{2.0}Tm_{0.6}Ca_{0.4}$ | 0.40 | 0.73 | 0.65 | 905 | 1.03 | 5.3 | 105 |
| 16 | $Eu_{2.2}Tm_{0.5}Ca_{0.3}$ | 0.25 | 0.75 | 0.63 | 990 | 1.15 | 5.2 | 118 |
| 17 | $Eu_{2.4}Tm_{0.4}Ca_{0.2}$ | 0.22 | 0.60 | 0.77 | 980 | 1.59 | 5.6 | 164 |
| 18 | $Eu_{2.4}Tm_{0.4}Ca_{0.2}$ | 0.22 | 0.43 | 0.80 | 995 | 1.90 | 4.3 | 181 |
| 19 | $Eu_{1.0}Tm_{1.2}Ca_{0.8}$ | 0.8 | 0.4 | 1.05 | 595 | 1.52 | 4.0 | 152 |
| 20 | $Eu_{0.5}Tm_{1.3}Ca_{1.2}$ | 1.20 | 0.45 | 1.8 | 282 | 0.98 | 4.1 | 96 |
| 21 | $Eu_{1.1}Tm_{0.9}Ca_{1.0}$ | 0.95 | 0.55 | 0.83 | 674 | 0.96 | 5.1 | 94 |
| 22 | $Eu_{0.7}Tm_{1.4}Ca_{0.9}$ | 0.85 | 0.10 | 2.20 | 368 | 2.25 | 4.7 | 203 |
| 23 | $Eu_{2.0}Tm_{0.3}Ca_{0.7}$ | 0.70 | 0.65 | 0.59 | 902 | 0.91 | 4.9 | 96 |
| 24 | $Eu_{1.1}Tm_{1.2}Ca_{0.7}$ | 0.70 | 0.20 | 1.40 | 560 | 2.20 | 4.4 | 232 |
| 25 | $Eu_{2.1}Tm_{0.5}Ca_{0.4}$ | 0.40 | 0.32 | 1.04 | 890 | 2.31 | 5.8 | 211 |
| 26 | $Eu_{2.5}Tm_{0.2}Ca_{0.3}$ | 0.25 | 0.82 | 0.54 | 1100 | 0.90 | 6.2 | 92 |
| 27 | $Eu_{2.4}Tm_{0.4}Ca_{0.2}$ | 0.16 | 0.77 | 0.46 | 1250 | 1.25 | 4.2 | 130 |
| 28 | $Eu_{2.2}Tm_{0.6}Ca_{0.2}$ | 0.16 | 0.60 | 0.65 | 1080 | 1.62 | 4.8 | 167 |
| 29 | $Eu_{2.1}Tm_{0.7}Ca_{0.2}$ | 0.16 | 0.44 | 0.84 | 1005 | 1.96 | 5.6 | 189 |
| 30 | $Eu_{0.5}Tm_{1.4}Ca_{1.1}$ | 1.10 | 0.30 | 2.11 | 280 | 1.32 | 4.1 | 140 |
| 31 | $Eu_{0.5}Tm_{1.5}Ca_{1.0}$ | 1.00 | 0.20 | 2.10 | 310 | 1.65 | 4.0 | 171 |

What is claimed is:

1. A garnet single crystal film for magnetic bubble domain devices having a composition represented by the formula $$R_3(Fe_{3-x}M_x)(Fe_{2-y}M'_y)O_{12}$$

wherein R is at least one member selected from the group consisting of Y, Ca, La, Ce, Pr, Nd, Pm, Sm, Eu, Gd, Tb, Dy, Ho, Er, Tm, Yb and Lu; M is at least one member selected from the group consisting of Ge, Al, Si and Ga; M' is at least one member selected from the group consisting of Sc, In, Cr, Zr and Sn; and x and y each have a value within the range H in FIG. 2.

2. A garnet single crystal film according to claim 1, wherein the thickness of said garnet film is about 0.2 to about 4 μm.

3. A garnet single crystal film according to claim 1, wherein said garnet film is formed on a $Gd_3Ga_5O_{12}$ single crystal.

4. A garnet single crystal film according to claim 1, wherein the at least one member represented by R is at the dodecahedral sites, the at least one member represented by M is at the tetrahedral positions and the at least one member represented by M′ is at the octahedral positions.

5. A garnet single crystal film according to claim 1, wherein said garnet film has a magnetic bubble domain of less than 2 μm.

6. A garnet single crystal film according to claim 1, wherein the range H in FIG. 2 is surrounded by curves C, D, E and F in the accompanying drawing.

7. A garnet single crystal film according to claim 1, wherein said garnet film has a saturation magnetization not exceeding 1,000 gauss, an exchange stiffness coefficient of from $1\times10^{-7}$ erg/cm to $2\times10^{-7}$ erg/cm and a curie temperature of at least 100° C.

8. A garnet single crystal film according to claim 7, wherein y has a value ranging from greater than 0.12 to not more than 0.75 and x has a value ranging from 0.20 to less than 1.20.

9. A garnet single crystal film according to claim 8, wherein x has a value ranging from 0.20 to 0.80.

* * * * *